US008506760B2

(12) United States Patent
Schuecker

(10) Patent No.: US 8,506,760 B2
(45) Date of Patent: Aug. 13, 2013

(54) COKING PLANT COMPRISING TWO OVEN CHAMBER ROWS ARRANGED IN PARALLEL

(75) Inventor: Franz-Josef Schuecker, Castrop-Rauxel (DE)

(73) Assignee: UHDE GmbH, Dortmund (DE)

( * ) Notice: Subject to any disclaimer, the term of this patent is extended or adjusted under 35 U.S.C. 154(b) by 401 days.

(21) Appl. No.: 12/921,451

(22) PCT Filed: Mar. 12, 2009

(86) PCT No.: PCT/EP2009/001753

§ 371 (c)(1),
(2), (4) Date: Nov. 18, 2010

(87) PCT Pub. No.: WO2009/121469

PCT Pub. Date: Oct. 8, 2009

(65) Prior Publication Data

US 2011/0056821 A1 Mar. 10, 2011

(30) Foreign Application Priority Data

Apr. 4, 2008 (DE) ..... 10 2008 017 611

(51) Int. Cl.
*C10B 15/00* (2006.01)
*C10B 35/00* (2006.01)

(52) U.S. Cl.
USPC ..... 202/113; 201/26; 202/133; 202/262; 202/270; 414/215

(58) Field of Classification Search
USPC ..... 202/113, 133, 137, 262, 270; 201/26; 414/215, 584
See application file for complete search history.

(56) References Cited

U.S. PATENT DOCUMENTS 4,153,515 A * 5/1979 Gregor et al. ..... 202/262

FOREIGN PATENT DOCUMENTS

| | | | |
|---|---|---|---|
| DE | 10154786 | A | 5/2003 |
| JP | 04258688 | A | 9/1992 |
| WO | 2001018150 | A | 3/2001 |

OTHER PUBLICATIONS

Machine translation of DE 101 54 786 (May 2003), 3 pages.*

* cited by examiner

*Primary Examiner* — Jill Warden
*Assistant Examiner* — Joye L Woodard
(74) *Attorney, Agent, or Firm* — Andrew Wilford

(57) ABSTRACT

A coking plant first and second longitudinally extending rows of oven chambers all of generally the same width and generally the same longitudinal spacing and together defining a corridor into which the chambers all open. The first and second rows are longitudinally offset from each other by a predetermined distance that is greater than the oven-chamber width A device for servicing the oven chambers and movable longitudinally in the corridor between the two rows of oven chambers has first and second service machines transversely facing the respective first and second rows and operable to service the chambers thereof. A coupling of variable longitudinal length between the first and second machines operable can vary the longitudinal spacing between the two machines.

8 Claims, 1 Drawing Sheet

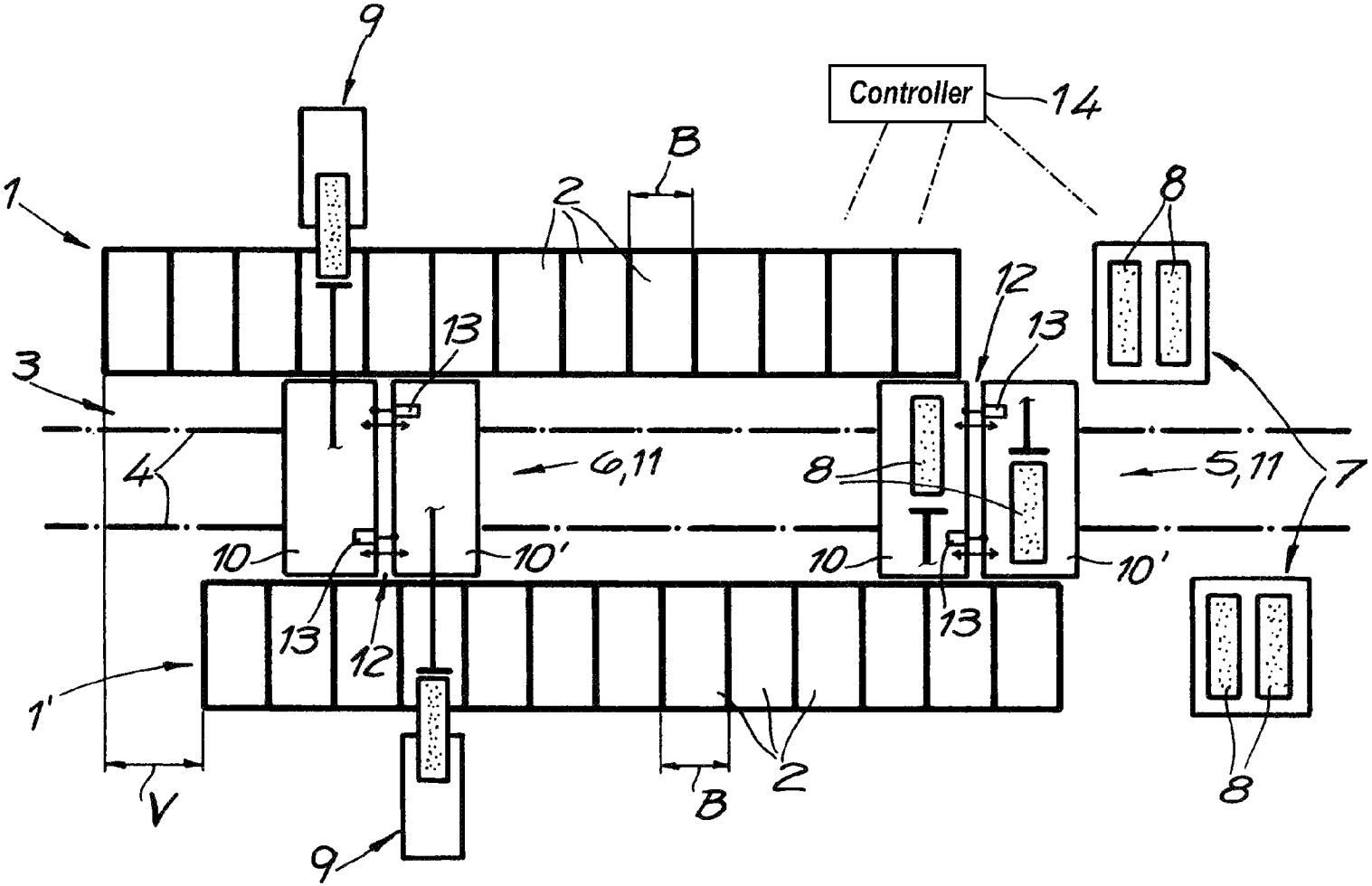
Controller
14
7
8
5,11
10'
13
12
10
2
B
6,11
9
4
3
1
1'
V

COKING PLANT COMPRISING TWO OVEN CHAMBER ROWS ARRANGED IN PARALLEL

CROSS REFERENCE TO RELATED APPLICATIONS

This application is the US-national stage of PCT application PCT/EP2009/001753, filed 12 Mar. 2009, published 8 Oct. 2009 as WO2009/121469, and claiming the priority of German patent application 102008017611.7 itself filed 4 Apr. 2008.

FIELD OF THE INVENTION

The invention relates to a coal-coking plant operated in particular according to the non-recovery or the heat-recovery method.

BACKGROUND OF THE INVENTION

The coking plant comprises a first row of oven chambers that all have the same width and, within tolerances, the same spacing and, parallel to the first row, a second row of oven chambers whose number, width, and spacing correspond to those of the first row of oven chambers, coal-input ports of all the oven chambers facing a corridor between the two rows of oven chambers. The two rows of oven chambers are offset with respect to one another in the longitudinal direction. In addition, the plant has at least one device for servicing the oven chambers and movable in the corridor between the two rows of oven chambers on tracks parallel to the oven chambers.

The oven chambers are charged via lateral coal input ports facing the corridor. For this purpose, a coal-charging machine is aligned on a track section in front of the oven chamber in the corridor between the parallel rows of oven chambers, which charging machine then loads loose coal or a block of precompacted coal into the oven chamber. After coking the coal, the finished coke block is expelled by a coke push-out machine from the oven chamber through a chamber opening on the rear side of the oven chamber and fed to a coke-quenching car.

Known from DE 101 54 786 A1 is a coking plant comprising two rows of oven chambers running parallel to one another, the so-called coking batteries. Two service machines are movable on rails between the two rows of oven chambers. One service machine has oppositely directed devices for charging the oven chambers in both rows of oven chambers and the other service machine comprises devices for pushing out coke so that oven chambers in both rows of oven chambers can be simultaneously charged with coal or emptied after coking. The service machines are only practicable for small-volume ovens. The rows of oven chambers are longitudinally offset with respect to one another by a longitudinal offset corresponding to an oven chamber width. The dimensions of the service devices installed on the service machine must be adapted to this offset. The relatively small offset of the rows of oven chambers produces constraints for the arrangement of the service devices on the chassis. Finally, the known concept requires an oven spacing that is always the same so that the oven chambers of the two rows of oven chambers can be serviced simultaneously without correcting the position of the service machine. Such an assumption is unrealistic in coking plants on account of the dimensions of these buildings. In practice, the width of the coal cake must therefore be reduced so that it can still be placed in the oven chambers in the event of fairly large positional deviations of the oven chambers to be charged. This reduces the throughput capacity of the plant and therefore its economic viability.

OBJECT OF THE INVENTION

It is the object of the invention to provide a device for servicing the oven chambers of a coking plant of the type described above, which device is constructed simply from modular parts and can compensate for positional deviations of the oven chambers.

SUMMARY OF THE INVENTION

Starting from a coking plant having the features described above, the object is achieved according to the invention in that the longitudinal offset between the two rows of oven chambers is larger than the width of one oven chamber and that the device for servicing the oven chambers is composed of individual service machines that form a machine group and that are connected to one another by means of a length-adjustable coupling, the service machines being directed in opposite directions to one another so that each row of oven chambers is assigned the same number of service machines of the machine group. The alignment of the service machines within the movable machine group is effected by means of a coupling that is adjustable in length in the direction of travel. This way, a precise positioning of the service machines of the machine group in front of the lateral openings of the oven chambers is possible and the ovens can substantially be charged to the maximum and used to full capacity. At the same time, adjustment of the coupling between the machines of the machine group requires a significantly lower expenditure than the shunting of the heavy machine with its sluggish machine driving system.

The coupling can comprise at least one adjuster for length adjustment that can be controlled by a machine controller, for example a hydraulic cylinder/piston arrangement with an integrated distance-measuring unit. In a further embodiment, the invention teaches that control values for adjusting the coupling length are stored in the machine controller, these control values being assigned to predefined positions of the machine group along the rows of oven chambers.

The width of the service machines is adapted to the width of the longitudinal offset that the two parallel-disposed rows of oven chambers have with respect to one another. Accordingly, it is possible to use service machines that are broader and therefore easier to service and maintain compared with machines whose width merely corresponds to one oven chamber. As a result, more efficient charging of each individual chamber is ultimately possible. Advantageously, the longitudinal offset between the rows of oven chambers and therefore also the width of the service machines is no greater than twice the width of one oven chamber.

Due to the arrangement of the service machine to form a machine group, a plurality of oven chambers of the coking plant according to the invention can be charged and/or emptied simultaneously. Usually each machine group consists of an even number of coal-charging machines or of an even number of coke push-out machines, combinations however of one or more coal-charging machines with one or more coke push-out machines not being excluded. The common feature of all the machine combinations is an increase in the coke throughput of the coking plant due to the simultaneous charging of a plurality of oven chambers of which at least one is part of the first row of oven chambers and at least one oven chamber is part of the opposite row of oven chambers.

According to a preferred embodiment of the invention, the machine group is composed of structurally identical service machines. As a result, on the one hand, maintenance of the service machines is made easier and, on the other hand, the structurally identical machines can be produced in larger numbers and therefore more cost-effectively. Each service machine preferably has a chassis that is characterized by a low mounting height and comprises two axles.

BRIEF DESCRIPTION OF THE DRAWING

The invention will be explained hereinafter with reference to a drawing showing a single embodiment.

DETAILED DESCRIPTION OF THE INVENTION

The single FIGURE of the drawing shows highly schematically the basic outline of a coking plant having two opposite oven-chamber rows 1, 1'. Each oven-chamber row 1, 1' has a plurality of structurally identical oven chambers 2 of width B. The spacing between the oven chambers 2 in the rows is substantially the same; it is merely subject to tolerance variations due to the structural dimension of the entire plant. The oven-chamber rows 1, 1' are parallel and offset with respect to one another. The longitudinal offset V is greater than the width B of an oven chamber 2. The coal input ports of all the chambers 2 face a corridor 3 between the two oven-chamber rows 1, 1'. First and second service devices 5, 6 for the oven chambers can move along a pair of 4 extending longitudinally along the corridor 3. The first device 5 is used for charging the oven chambers 2. It receives blocks 8 of precompacted coal at transfer stations 7 and then approaches two oven chambers 2 needing charging and inserts a respective coal block into each of them. It follows from the diagram in the FIGURE that two oven chambers 2 can be charged simultaneously, one belonging to the first oven-chamber row 1 and the other belonging to the second oven-chamber row 1'. The second device 6 has equipment for pushing out coke. After coking, the coke is transferred to coke quenching cars 9 that can be moved along the backs of the oven-chamber rows 1, 1'. The FIGURE shows that the coke can be pushed simultaneously out of two oven chambers 2, one oven chamber belonging to the first oven-chamber row 1 and the other oven chamber belonging to the second oven-chamber row 1'.

The devices 5, 6 for servicing the oven chambers 2 each have two respective service machines 10, 10' that form a machine group 11 and are connected to one another by a length-adjustable coupling 12. The service machines 10, 10' are directed in opposite directions from one another so that each oven-chamber row 1, 1' is assigned the same number of service machines 10 or 10' of the machine group 11. The service machines 10, 10' combined to form a machine group 11 are structurally identical machines that preferably each have a chassis with two axles. The FIGURE shows that the longitudinal offset V between the oven-chamber rows 1, 1' is larger than the width B of one oven chamber. As a result, the service machines 10, 10' combined to form a machine group 11 can be configured to be of the same width, which is advantageous for the accessibility of the servicing devices and their maintenance.

The coupling 12 between the service machines combined to form a machine group 11 is fitted with at least one adjuster 13 for length adjustment that can be controlled, for example, by a machine controller illustrated schematically at 16. In particular, hydraulic cylinder-piston arrangements having an integrated distance-measuring unit can be used as adjusters 13. Control values for adjusting the coupling length can be stored in the machine controller 16, the control values being assigned to predetermined positions of the machine group 11 along the oven-chamber rows 1, 1'.

For servicing an oven chamber 2 to be charged or emptied, the machine group 11 is moved on the tracks in such a manner that one of the two service machines 10, 10' stops before a chamber predefined by the machine controller 16 so that the machine 10 can service this oven chamber. The alignment of the second service machine 10' in the group is made by adjusting or controlling the length-adjustable coupling 12. In this way, both service machines 10, 10' are optimally aligned with respect to the respective chamber openings so that the oven chambers assigned to the different oven-chamber rows 1, 1' can be simultaneously charged or emptied, the total chamber width being usable for the filling.

In the illustrated embodiment, a machine group comprising two oppositely aligned coal-charging machines and a machine group comprising two oppositely aligned coke push-out machines are provided. However, the modular concept of the invention also makes it possible to combine a larger but even number of coal-charging machines or coke push-out machines to form a machine group.

The invention claimed is:

1. A coking plant comprising:

a first longitudinally extending row of oven chambers all of generally the same width and generally the same longitudinal spacing;

a second longitudinally extending row of oven chambers parallel to the first oven-chamber row, the number, width, and spacings thereof corresponding generally to those of the first oven-chamber row, the rows defining a longitudinally extending corridor between each other, the oven chambers having coal input ports opening transversely inward into the corridor, the first and second rows being longitudinally offset from each other by a predetermined distance that is greater than the oven-chamber width;

a device for servicing the oven chambers and movable longitudinally in the corridor between the two rows of oven chambers, the device having first and second service machines transversely facing the respective first and second rows and operable to service the chambers thereof, and a coupling of variable longitudinal length between the first and second machines operable for varying the longitudinal spacing between the two machines.

2. The coking plant according to claim 1, further comprising:

a machine controller, the coupling having at least one adjuster controllable by the machine controller for length adjustment.

3. The coking plant according to claim 2, wherein control values for adjusting the coupling length are stored in the machine controller, the control values being assigned to predetermined positions of the machine group along the oven-chamber rows.

4. The coking plant according to claim 1, wherein the machines of the device are two oppositely aligned coal-charging machines or two oppositely aligned coke push-out machines.

5. The coking plant according to claim 1, wherein the machines of the device are of structurally identical service machines.

6. The coking plant defined in claim 1, further comprising longitudinally extending rails on which the first and second machines ride longitudinally.

7. The coking plant defined in claim 6, further comprising control means for longitudinally shifting the first machine to align it transversely with one of the oven chambers of the first row and for thereafter adjusting the length of the coupling for aligning the second machine to align it transversely with a respective one of the chambers of the second row.

8. The coking plant defined in claim 6, wherein the machines are each a coal-loading device or a coke-pushout device.

* * * * *